US005887667A

United States Patent [19]

Van Zante et al.

[11] Patent Number: 5,887,667

[45] Date of Patent: Mar. 30, 1999

[54] METHOD AND MEANS FOR DRILLING AN EARTHEN HOLE

[75] Inventors: William R. Van Zante; Craig A. Van Zante, both of Pella, Iowa

[73] Assignee: Ring-O-Matic Manufacturing Company, Inc., Pella, Iowa

[21] Appl. No.: 895,315

[22] Filed: Jul. 16, 1997

[51] Int. Cl.[6] ..... E02F 3/88; E21B 21/12

[52] U.S. Cl. ..... 175/67; 175/218; 175/424; 37/323; 37/330; 37/331; 210/923; 405/248

[58] Field of Search ..... 175/67, 218, 224; 37/322, 323, 330, 331; 210/923; 405/240, 248; 125/424, 135, 162, 203, 213

[56] References Cited

U.S. PATENT DOCUMENTS

| | | | |
|---|---|---|---|
| 1,314,793 | 9/1919 | Ebeling . | |
| 1,415,113 | 5/1922 | Phillips, Jr. . | |
| 1,719,668 | 7/1929 | McEachern . | |
| 2,678,203 | 5/1954 | Huff . | |
| 3,543,422 | 12/1970 | Plutchak . | |
| 3,673,716 | 7/1972 | Trondle | 37/61 |
| 3,938,600 | 2/1976 | Essneier | 175/422 |
| 3,965,687 | 6/1976 | Shaw | 61/46 |
| 4,319,784 | 3/1982 | Claringbull | 299/64 |
| 4,412,394 | 11/1983 | Coker | 37/57 |
| 4,479,741 | 10/1984 | Berti et al. | 161/1 |
| 4,744,698 | 5/1988 | Dallimer et al. | 405/226 |
| 4,760,656 | 8/1988 | East | 37/87 |
| 4,871,037 | 10/1989 | Warren et al. | 175/67 |
| 4,936,059 | 6/1990 | Hashish et al. | 175/424 X |
| 4,991,321 | 2/1991 | Artzberger | 37/62 |
| 5,016,717 | 5/1991 | Simons et al. | 175/66 |
| 5,361,855 | 11/1994 | Schuermann et al. | 175/67 |
| 5,408,766 | 4/1995 | Pobihushchy | 37/323 |

*Primary Examiner*—Roger Schoeppel
*Attorney, Agent, or Firm*—Zarley, McKee, Thomte, Voorhees & Sease

[57] ABSTRACT

An earthen hole drilling device has an elongated tube having first and second ends. A source of vacuum pressure is connected to the first end of the tube. A rotary fluid nozzle is attached to the second end of the tube and is adapted to direct a rotary jet of fluid to intersect the space immediately beyond the second end of the tube. An elongated fluid line has first and second ends with the first end thereof being connected to a source of fluid under pressure, such as water, and the second end of the fluid line is connected to the nozzle. The tube normally has a length of five or six feet with handles thereon so as to be manipulated by a single worker. The method of drilling an earthen hole involves the steps of emitting a rotary jet of fluid into the space behind the second end of the tube to moisten and dislodge particles of earth in the earthen hole being created. Vacuum pressure in the tube will withdraw the fluid discharged from the nozzle along with the dislodged particles of earth all of which are pulled upwardly through the tube to be remotely discharged from the location where the earthen hole is being created. A hollow housing in the shape of a hollow cone is preferably placed around the nozzle whereupon the rotary jet of fluid from the nozzle is discharged within the housing and is directed towards the open lower end of the housing.

15 Claims, 4 Drawing Sheets

METHOD AND MEANS FOR DRILLING AN EARTHEN HOLE

BACKGROUND OF THE INVENTION

Drilling small diameter holes for fence posts, wells and the like are commonly accomplished by mechanical means, such as augers, which leave a substantial amount of residue on the ground surface where the hole is created. This residue is also usually present when hydraulic means instead of mechanical means are used to create the hole. Mechanical means are unsatisfactory for use in exploratory drilling to locate the position of an underground line, because the drilling apparatus may sever or damage the line when the line is located. Also, hole digging typically consumes considerable labor, and either mechanical or hydraulic power.

It is therefore a principal object of this invention to provide a method of and means for drilling an earthen hole to locate underground lines that will not damage the line when located.

A further object of this invention is to provide a method of and means for drilling an earthen hole that will not leave a residue of earthen debris around the top of the hole.

A still further object of this invention is to provide a method of and means for drilling an earthen hole that can operate in inaccessible locations, with a minimum of physical labor and applied power.

These and other objects will be apparent to those skilled in the art.

SUMMARY OF THE INVENTION

The earthen hole drilling device of this invention has an elongated tube having first and second ends. A source of vacuum pressure is connected to the first end of the tube. A rotary fluid nozzle is attached to the second end of the tube and is adapted to direct a rotary jet of fluid to intersect the space immediately beyond the second end of the tube. An elongated fluid line has first and second ends with the first end thereof being connected to a source of fluid under pressure, such as water, and the second end of the fluid line is connected to the nozzle. The tube normally has a length of five or six feet with handles thereon so as to be manipulated by a single worker.

When fluid is emitted from the nozzle, a rotary jet of fluid is directed to the space beyond the second end of the tube to moisten and dislodge particles of earth in the earthen hole being created. Vacuum pressure in the tube will withdraw the fluid discharged from the nozzle along with the dislodged particles of earth all of which are pulled upwardly through the tube to be remotely discharged from the location where the earthen hole is being created. A hollow housing in the shape of a hollow cone is preferably placed around the nozzle whereupon the rotary jet of fluid from the nozzle is discharged within the housing and is directed towards the open lower end of the housing.

DESCRIPTION OF THE PREFERRED EMBODIMENT

Figure 1:
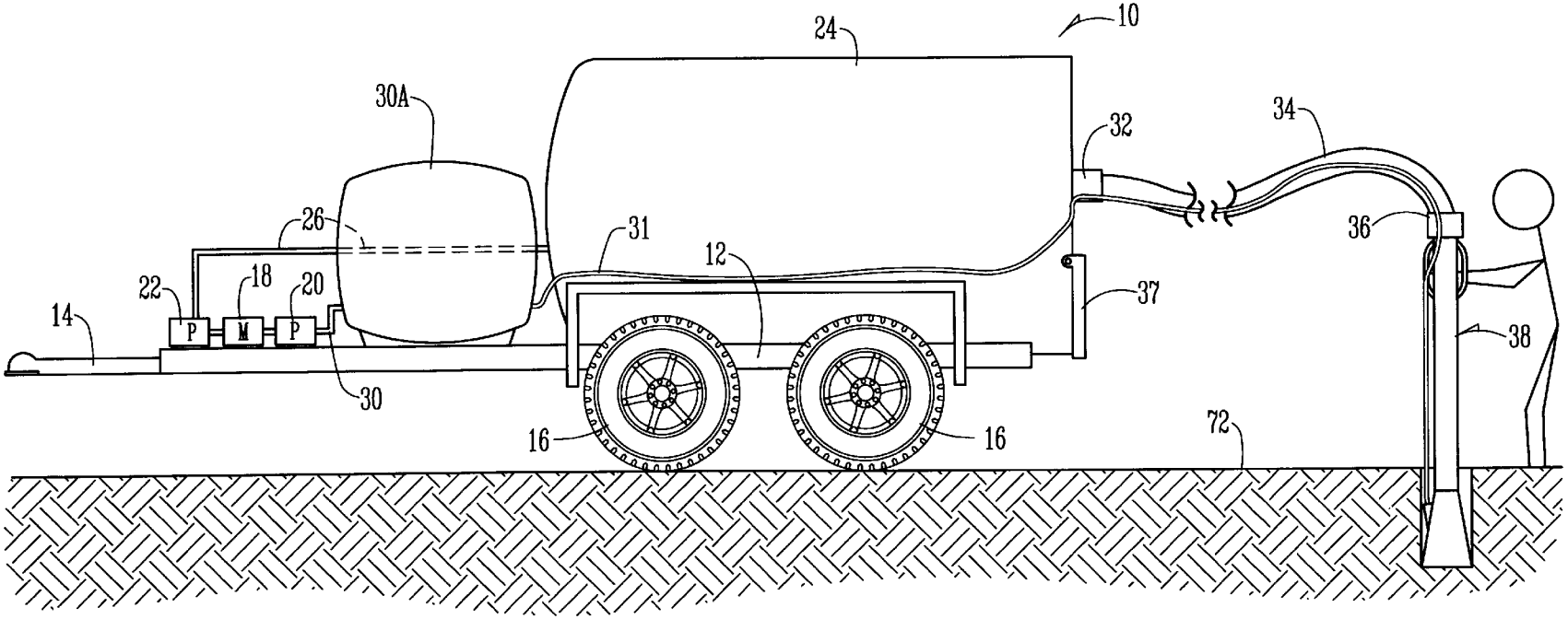
FIG. 1 is a side elevational view of the device of this invention connected to an appropriate discharge reservoir to receive the debris from the drilling operation.

As shown in FIG. 1, a liquid waste disposal vehicle 10 has a frame 12, a tongue 14, and conventional rotatable support wheel 16. The motor 10 is mounted on frame 12 and is operatively connected to hydraulic pump 20 and to vacuum pump 22 by conventional means. Vacuum pump 22 is connected to conventional vacuum tank 24 and a discharge gate 26 by a conventional vacuum line 28.

A conventional first water line 30 connects water pump 20 to water tank 30A. A second water line 31 connects the water tank 30A with the device of this invention as will be explained hereafter. A vacuum port 32 is located on the rearward end of vacuum tank 24, and a conventional elongated flexible vacuum line 34 is connected to port 32 in any convenient manner. The outward end of vacuum line 34 terminates in connector 36 (FIG. 1).

The foregoing structure, except for the water pump 20, the water tank 30A, and the water lines 30 and 31 are conventional and are used for a plurality of suction functions wherein waste water is pulled into tank 24 through line 34 where it is ultimately dumped therefrom in conventional manner by a gate 37 on the rearward end of tank 24.

Figure 2:
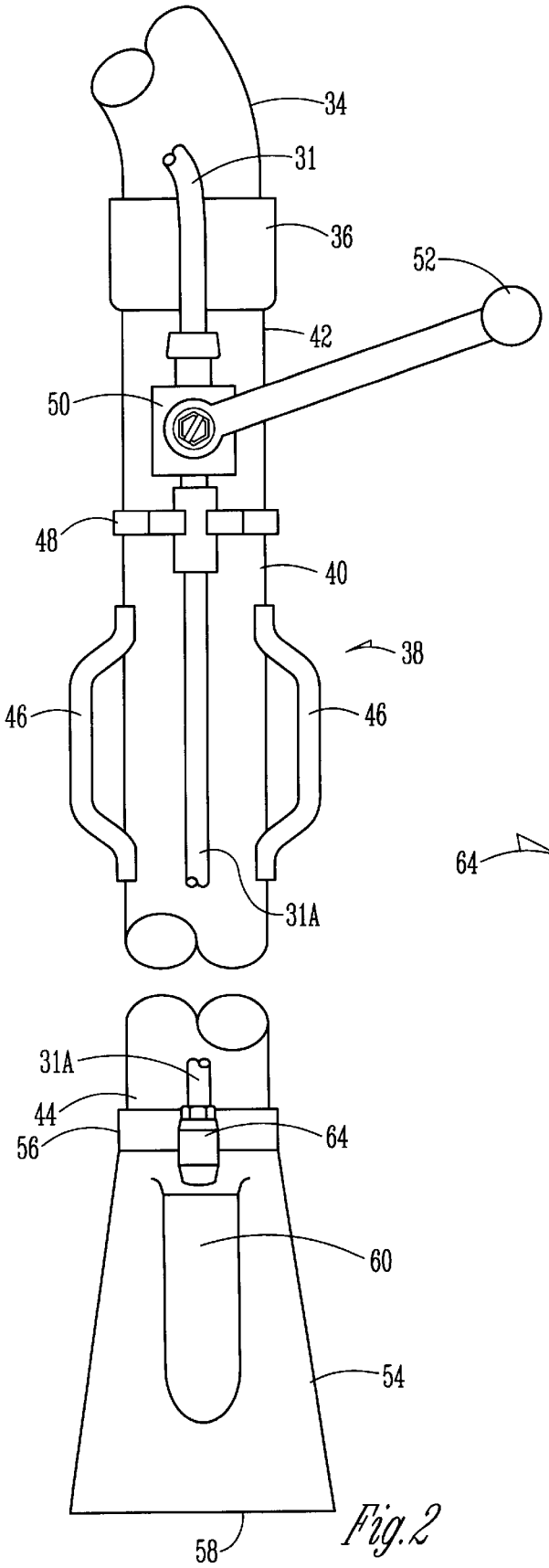
FIG. 2 is an enlarged scale elevational view of the device of this invention.

The hole creating assembly 38 of this invention includes a rigid tube 40 which has an upper end 42 and a lower end 44. (FIG. 2) The upper end 42 is connected to flexible vacuum pipe 34 by means of connector or coupling 36. A pair of handles 46 are rigidly secure to tube 40 adjacent its upward end. A clamp 48 extends around tube 40 and embraces rigid water line 31A which is connected to water line 31 by an conventional means. A valve 50 is imposed in line 31A and is selectively opened and closed by operating arm 52 to permit water under pressure from pump 20 to be either delivered to rigid pipe 31A or to be shut off, as the case may be.

A lightweight metal cone shaped shroud 54 is rigidly secured to the lower end 44 of tube 40, and has an upper end 56 and a lower end 58. Shroud 54 is of cast construction and has a shoulder 60 protruding outwardly therefrom with an aperture 62 therein. A hydraulic nozzle 64 is detachably mounted within aperture 62 and extends into the interior 65 of shroud 54.

Figure 3:
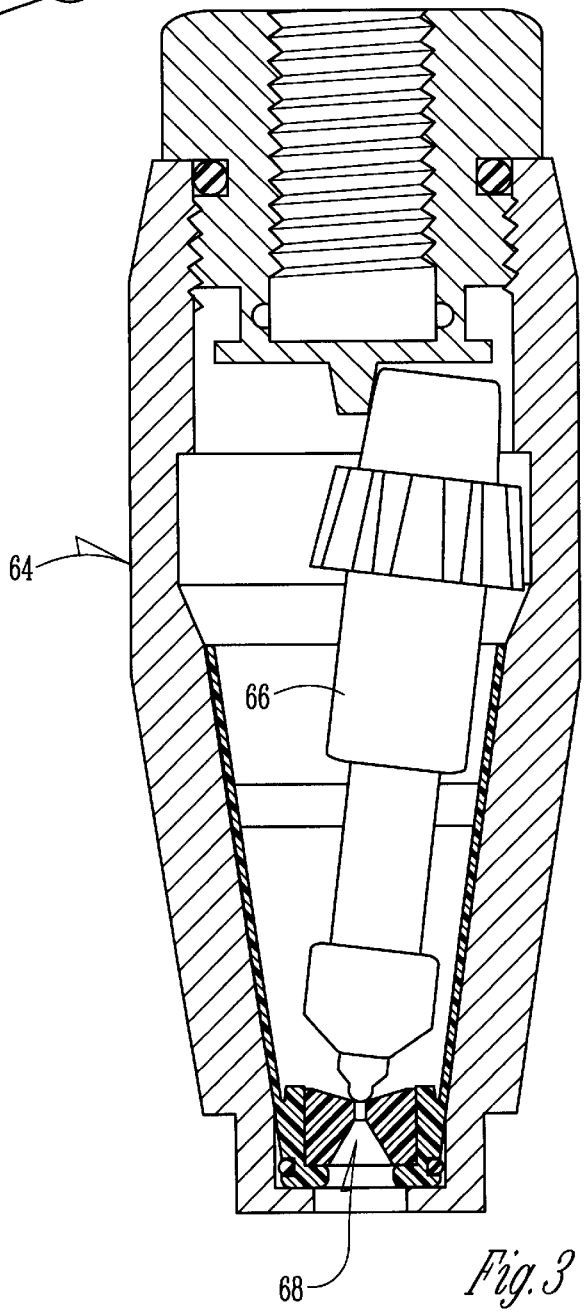
FIG. 3 is an enlarged scale sectional view of the nozzle used in this invention.
Figure 4:
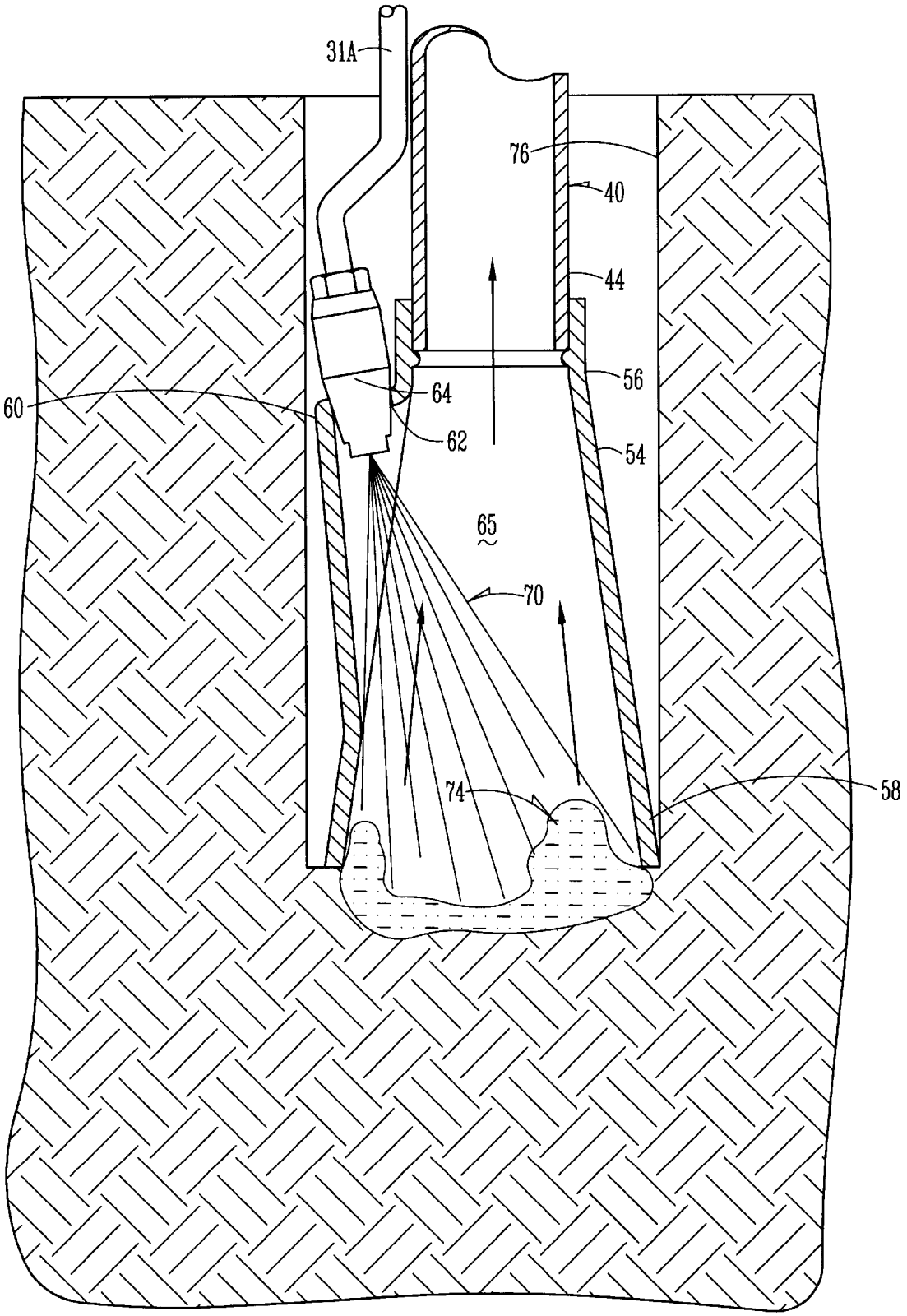
FIG. 4 is a sectional view of a hole being drilled by the apparatus of FIG. 2.

As shown in FIG. 3, nozzle 64 has a conventional rotary impeller 66 which imparts a rotary motion to water under pressure being delivered to the nozzle through water line 31A. The water under pressure causes the impeller 66 to float slightly upwardly so as to permit water under pressure to exit the nozzle in a rotating fashion through discharge 68 to create a rotary fan shaped jet 70. (FIG. 4) It should be understood that the nozzle 64 per se is not the subject of this invention for it is a conventional nozzle available on the market and used for various purposes.

In operation, the vehicle 10 is moved to the general proximity of where an earthen hole is to be created. The vacuum line 34 can be of any suitable length so as to permit the assembly 38 to be located at any desired point for drilling the hole remote from the vehicle itself.

The motor 18 is started to drive both the water pump and the vacuum pump 22. The water valve 50 is normally closed until the assembly 38 is mounted in a vertical position on the ground surface 72 where the hole is to be created obviously, the device of this invention can be used to drill holes at any angle, and even in a horizontal direction under sidewalks and the like if necessary. The bottom of shroud 54 is rested on the ground surface 72, and the pressurized water valve 50 is opened to permit water under pressure to flow through water line 31A to nozzle 64.

As described above, the nozzle 64 emits a rotary fan shaped jet 70 which moistens and dislodges the earth at the lower end 58 of the shroud. This creates a liquefied or emulsified portion of earthen material 74 (FIG. 4) which is exposed and pulled upwardly through the shroud and tube 40 and thence through vacuum tube 34 to be deposited in tank 24. Some downward pressure can be exerted on tube 40 by the operator exerting the force on handles 46. As the material 74 is pulled upwardly and outwardly from the shroud 54, the assembly 38 moves downwardly into the earth to create the cylindrical hole 76. A slight scarf or groove may be formed in the side of the hole 76 by the protruding upper end of nozzle 64. However, this does not create any appreciable resistance to the downward movement of the assembly 38 as the hole is being created.

After the hole has been created to its desired depth, or when the hole has been created to the extent that the underground line which is being exposed has been reached, the valve 50 is then closed and the assembly 38 is removed from the hole 76. The vehicle 10 can be moved either towards the hole 76 or to some remote location wherein the debris and residue from the digging operation, then residing in tank 24, can be discharged from the tank 24 through gate 37. Typically, frame 12 has means thereon for tilting tank 24 at an angle wherein the rearward end of the tank is lowered to the ground level. That apparatus has not been shown and is not critical to this invention.

Figure 5:
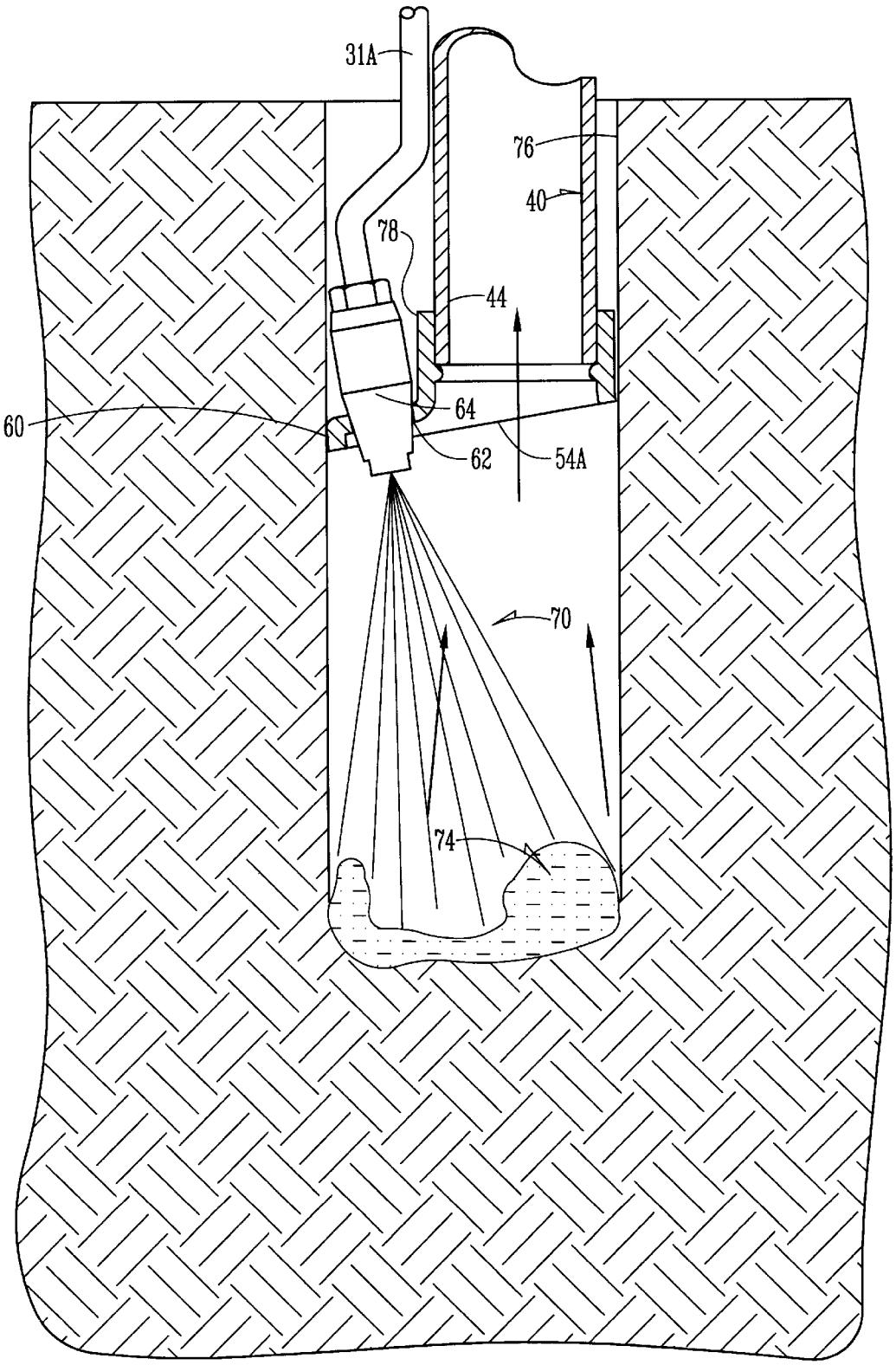
FIG. 5 is a sectional view similar to that of FIG. 4 but employs a separate embodiment of this invention wherein the cone shroud of FIGS. 1 through 4 is not used.

In rocky soil, it is sometimes desirable not to use the shroud 54 because the shroud impinges on rocks and tends to inhibit the downward movement of the assembly 38. Thus, the device of FIG. 5 is identical to the device shown in FIGS. 1 through 4 except that the shroud 54 has been removed and a bracket 78, resembling the shape of the upper end of shroud 54 is secured to the lower end of tube 40 to support the nozzle 64. Nozzle 64 operates in essentially the same way that it operated with respect to the device of FIGS. 1 through 4 whereupon the emulsified material 74 is still pulled upwardly through the tube 40 to permit the hole 76 to be created.

It is thus seen that the method and device of this invention permit earthen holes to be created quickly and easily and without any apprehension that any underground lines will be damaged. It is therefore seen that this invention will achieve at least all of its stated objectives.

What is claimed is:

1. An earthen hole drilling device, comprising, an elongated tube having first and second ends, a source of vacuum pressure adapted to be connected to said first end of said tube, a nozzle attached to said second end of said tubes, a rotary impeller mounted within said nozzle and adapted to direct a rotary jet of fluid from said nozzle to intersect the space immediately beyond said second end, an elongated fluid line having first and second ends, said first end of said fluid line adapted to be secure to a source of fluid under pressure, said second end of said fluid line connected to said nozzle, whereby when pressurized fluid flows through said nozzle, a rotary jet of fluid will be directed to the space beyond aid second end of said tube to moisten and dislodge particles of earth in an earth in an earthen hole being created, and whereupon the vacuum pressure in said tube will withdraw the fluid discharged from said nozzle and said dislodge particles of earth towards the first end of said tube to be remotely discharged from the location where said earthen hole is being created.

2. The device of claim 1 wherein a hollow housing is secured to said second end of said tube, said housing having an open outer end and encompassing said nozzle, whereupon a rotary jet of fluid from said nozzle is discharged within said housing and is directed towards the open outer end of said housing.

3. The device of claim 2 wherein the outer open end of said hollow housing is circular.

4. The device of claim 3 wherein the outer end of said hollow housing has a diameter greater than the diameter of said tube.

5. The device of claim 4 wherein said hollow housing is the shape of a cone.

6. The device of claim 2 wherein said hollow housing has a laterally extending shoulder which extends transversely from said tube, and said nozzle is mounted in said shoulder.

7. The device of claim 1 wherein said fluid line has a valve adjacent the first end of said tube.

8. The device of claim 1 wherein said tube is rigid.

9. The device of claim 1 wherein said tube has handles secured thereto adjacent its first end.

10. The device of claim 1 wherein said tube is connectable to a portable reservoir to receive fluid and earthen particles moved away from said nozzle by said vacuum pressure in said tube.

11. The device of claim 1 wherein said tube and said nozzle each have a center axis, with the center axis of said nozzle being at an angle with respect to the center axis of said tube.

12. The device of claim 11 wherein the center axes of said nozzle and said tubes intersect in the space beyond the end of said tube.

13. A method of creating an earthen hole, comprising, taking an elongated rigid tube having upper and lower ends connecting said upper end of said tube to a source of vacuum pressure, placing a fluid nozzle adjacent the lower end of said tube, connecting said nozzle to a source of fluid under pressure, placing a rotary impeller within said nozzle to create and to cause a rotary jet of fluid to discharge from said nozzle into the space beyond the lower end of said tube, placing said tube on an earthen surface where said earthen hole is to be created and applying downward pressure thereon to moisten and dislodge particles of earth in an earthen hole being created, and whereupon the vacuum pressure in said tube will withdraw the fluid discharged from said nozzle and said dislodged particles of earth towards the first end of said tube to be remotely discharged from the location where said earthen hole is created.

14. The method of claim 13 wherein said rotary jet of fluid is cone shaped and flares outwardly as it is discharged from said nozzle.

15. The method of claim 13 wherein a shroud housing is placed on the lower end of said tube and said rotary jet of fluid is directed towards an open lower end of said shroud housing.

* * * * *